US009821939B2

(12) United States Patent
Blin

(10) Patent No.: US 9,821,939 B2
(45) Date of Patent: Nov. 21, 2017

(54) COMPOSITE PACKAGE WITH HANDLE

(71) Applicant: MeadWestvaco Packaging Systems, LLC, Richmond, VA (US)

(72) Inventor: Patrick Blin, Chateauroux (FR)

(73) Assignee: WestRock Packaging Systems, LLC, Norcross, GA (US)

( * ) Notice: Subject to any disclaimer, the term of this patent is extended or adjusted under 35 U.S.C. 154(b) by 118 days.

(21) Appl. No.: 14/441,238

(22) PCT Filed: Nov. 7, 2013

(86) PCT No.: PCT/US2013/068840
§ 371 (c)(1),
(2) Date: May 7, 2015

(87) PCT Pub. No.: WO2014/074659
PCT Pub. Date: May 15, 2014

(65) Prior Publication Data

US 2015/0291328 A1 Oct. 15, 2015

(30) Foreign Application Priority Data

Nov. 8, 2012 (GB) ..... 1220145.5

(51) Int. Cl.
*B65D 75/00* (2006.01)
*B65D 71/30* (2006.01)
(Continued)

(52) U.S. Cl.
CPC ..... *B65D 71/30* (2013.01); *B65D 71/0007* (2013.01); *B65D 71/0029* (2013.01);
(Continued)

(58) Field of Classification Search
CPC ..... B65D 71/30; B65D 71/063; B65D 71/08; B65D 71/12; B65D 71/0029; B65D 71/20;
(Continued)

(56) References Cited

U.S. PATENT DOCUMENTS 3,750,874 A 8/1973 Detzel et al.
3,963,121 A * 6/1976 Kipp ..... B65D 71/22 206/155
(Continued)

FOREIGN PATENT DOCUMENTS

FR 2088289 1/1972
FR 2134711 12/1972
(Continued)

*Primary Examiner* — J. Gregory Pickett
*Assistant Examiner* — Rafael Ortiz
(74) *Attorney, Agent, or Firm* — WestRock Intellectual Property Group

(57) ABSTRACT

A composite package includes a preliminary package (70) and a carrying handle structure (60). The preliminary package includes a group of articles (C), contained and secured together as a unit by a wrapping film (80) disposed around the group. The carrying handle structure (60) is wrapped around the preliminary package and is provided with at least one foldable tab (100) that is forcibly pushed and folded inwardly of the carrying handle structure such that the wrapping film is punctured and at least part of the at least one foldable tab is disposed within the preliminary package for interlocking the carrying handle structure to the preliminary package.

11 Claims, 11 Drawing Sheets

(51) Int. Cl.
*B65D 71/20* (2006.01)
*B65D 71/54* (2006.01)
*B65D 71/60* (2006.01)
*B65D 71/48* (2006.01)

(52) U.S. Cl.
CPC ..... *B65D 71/20* (2013.01); *B65D 71/48* (2013.01); *B65D 2571/0082* (2013.01); *B65D 2571/00456* (2013.01)

(58) Field of Classification Search
CPC ..... B65D 71/0007; B65D 71/48; B65D 2571/0082; B65D 2571/00456
USPC ..... 206/427, 428, 432, 434, 497, 139, 140, 206/141, 146, 151, 144, 162; 229/117.14, 229/117.13
See application file for complete search history.

(56) References Cited

U.S. PATENT DOCUMENTS

| | | | | |
|---|---|---|---|---|
| 4,382,506 | A * | 5/1983 | Chaussadas | B65D 71/08 206/200 |
| 4,880,115 | A | 11/1989 | Chaussadas | |
| 6,116,421 | A | 9/2000 | Collins | |
| 2012/0012600 | A1 * | 1/2012 | Gonzalez | B65D 71/36 220/752 |

FOREIGN PATENT DOCUMENTS

| | | |
|---|---|---|
| FR | 2880000 | 6/2006 |
| WO | 03/033364 | 4/2003 |

* cited by examiner

COMPOSITE PACKAGE WITH HANDLE

REFERENCE TO RELATED APPLICATIONS

This application is a National Phase application of PCT Application PCT/US2013/068840, filed Nov. 7, 2013, which claims the benefit of priority of GB Application No. 1220145.5, filed on Nov. 8, 2012, each of which is hereby incorporated by reference in its entirety.

FIELD OF THE INVENTION

The present invention relates to a composite package comprising a plurality of articles wrapped together in a wrapping film such as, but not limited to, plastic heat-shrink wrap and comprising a handle structure. More specifically, but not exclusively, the handle structure is formed of non-elastic materials such as paperboard, and is placed around the plurality of film-wrapped articles.

BACKGROUND OF THE INVENTION

In the field of packaging it is often required to provide consumers with a package comprising multiple primary product containers; such multi-packs are desirable for shipping and distribution and for display of promotional information. For cost and environmental considerations, such cartons or carriers need to be formed from as little material as possible, and cause as little wastage in the materials from which they are formed as possible. Another consideration is the strength of the packaging and its suitability for holding and transporting large weights of articles.

It is known to use polymeric or plastics wrapping films to group and contain as a unit an otherwise unconnected plurality of articles, such as cans or bottles of beverage, or tins or cans of food. Typically, the wrapping films are shrunk by the application of heat about the articles to group them together as a unit that a consumer can grasp for ease of purchase and transportation home. Such packages, whilst economical to produce, can be difficult to carry. Ideally the package should be lifted with both hands and supported at the bottom of the package. This may be uncomfortable for the consumer. Indeed, to make carrying the package easier, some consumers puncture the wrapping film to create a hole through which they can partially insert their hand for ease of gripping the package. However, the elastic nature of the polymeric wrapping film, along with the considerable weight of the articles, can result in significant tearing of the wrapping film. If significant enough tearing occurs the entire package may fail, causing articles to spill out. This is undesirable. Furthermore, printing high-quality advertising and marketing graphics on such products is not possible. Though the wrapping film can be printed, once it is unevenly shrunk and stretched about the articles, the graphics are usually distorted. The quality and content of printing on packages can make a significant difference to the value of a product and can heavily influence a consumer's decision whether or not to purchase the product.

It is desirable therefore to provide a package that benefits from the easy and economical grouping and containment provided by the wrapping film, that is easier and more comfortable to carry, and which has a higher quality appearance.

SUMMARY OF INVENTION

The present invention seeks to overcome or at least mitigate the problems of the prior art.

According to an aspect of the present invention, there is provided a composite package comprising at least one preliminary package and a carrying handle structure, wherein the at least one preliminary package comprises a group of articles contained and secured together as a unit by a wrapping film disposed around the group and wherein the carrying handle structure is wrapped around the at least one preliminary package and wherein the carrying handle structure is provided with at least one foldable tab that is disposed within the at least one preliminary package for interlocking the carrying handle structure to the preliminary package.

Beneficially, the carrying handle structure is interlocked to the preliminary package to minimise or prevent any relative movement between the two. Further beneficially where the carrying handle structure is formed of a material that provides for the high-quality printing of graphics and indicia, (for example paperboard), a large load of articles can be packaged using a cheaper material and that preliminary package enhanced by a handle structure and high-quality printing on panels of the carrying structure that can provide a bill-board effect. In this way the composite package is easier for the consumer to handle, more aesthetically pleasing to the consumer, potentially more eye-catching or attractive and thereby more valuable.

Optionally, the at least one foldable tab secures the carrying handle structure to the at least one preliminary package.

Optionally, the at least one foldable tab is forcibly pushed or displaced inwardly of the carrying handle structure such that the wrapping film is punctured and at least part of the at least one foldable tab is disposed internally of the wrapping film of the preliminary package.

Optionally, the at least one preliminary package comprises two or more preliminary packages and wherein the two or more preliminary packages are stacked one on top of another.

Optionally, the at least one foldable tab is formed within a first bottom panel of the carrying handle structure and wherein the at least one foldable tab forms part of a two-part complementary mechanical locking mechanism that secures the first bottom panel to a second bottom panel of the carrying handle structure.

Optionally, the two-part complementary mechanical locking mechanism comprises a series of at least three male locking tabs and a series of at least three female locking apertures, and wherein each male tab comprises a leading head and shoulders wider than the head, and wherein the shoulders act as an anchor to interlock the carrying handle structure and the at least one preliminary package.

Alternatively, a composite package is provided wherein the two-part complementary mechanical locking mechanism comprises two parallel rows of four male locking tabs and two parallel rows of four female locking apertures, and wherein the female locking apertures are each covered by a retaining tab prior to the male locking tabs being inserted into the female locking apertures.

According to another aspect of the invention for which protection is sought, there is provided a blank for forming a carrying handle structure, the blank comprising an outer handle strap panel extending between two handle structure wall panels and first and second inner handle panels for reinforcing the outer handle strap panel, the inner handle panels being connected to the outer handle strap panel such that the first and second inner handle panels are disposed on the opposed sides of the outer handle strap panel and extend alongside the outer handle strap panel, the outer handle strap panel and the first and second inner handle panels together provide a handle-forming panel section of the blank that is disposed between the two handle structure wall panels, and wherein the maximum width of the handle-forming panel section is generally equal to the maximum width of either of the two handle structure wall panels.

In this way, the first and second inner handle panels are sized and structured to provide as much reinforcement to the outer handle strap panel as possible, without increasing the area of material that would otherwise have been used to form the blank.

Preferably, the blank has a footprint having a maximum end-to-end length and a maximum width and wherein the maximum width of the handle-forming panel section is about equal to the maximum width of the footprint of the blank.

Optionally, the blank comprises first and second bottom panels and wherein the maximum width of the footprint of the blank is defined by the width of the first or second bottom panel.

Optionally, the two handle structure wall panels are first and second side panels respectively and wherein the maximum width of the footprint of the blank is defined by the width of the first or second side panel.

According to yet another aspect of the invention for which protection is sought, there is provided a composite package comprising a preliminary package and a carrying handle structure, wherein the preliminary package comprises a group of articles contained and secured together as a unit by a wrapping film disposed around the group, and wherein the carrying handle structure comprises a top wall, first and second side walls and a bottom wall, and wraps around the preliminary package, and wherein the carrying handle structure is provided with an outer strap handle panel in the top wall, which is reinforced by first and second inner handle panels disposed in overlapping relationship with the outer strap handle panel and wherein the sum of the surface area of the first and second inner handle panels is greater than the surface area of the outer strap handle panel.

According to yet another aspect of the invention for which protection is sought, there is provided a composite package comprising a preliminary package and a carrying handle structure, wherein the preliminary package comprises a group of articles contained and secured together as a unit by a wrapping film disposed around the group, and wherein the carrying handle structure comprises a top wall, first and second side walls and a bottom wall and wraps around the preliminary package, and wherein the carrying handle structure is provided with an outer strap handle panel in the top wall, the outer strap handle panel being reinforced by first and second inner handle panels disposed in overlapping relationship with the outer strap handle panel to form a handle and wherein leg portions formed contiguously with each of the first and second inner handle panels reinforce part of the first and second side walls.

Optionally, the part of the first and second side walls reinforced by the leg portions have an aperture for receiving an upper portion of an article contained in the preliminary package such that upon raising of the handle above a plane of a top surface of the preliminary package, the leg portions and corresponding parts of the first and second side walls can be moved to accommodate the raising of the handle above the plane of the top surface of the preliminary package.

Optionally, the leg portions are connected to an edge of each of the first and second side walls by a frangible connection when the carrying handle structure is in blank form, the frangible connection is broken during construction such that the leg portions are not directly attached to the first and second side walls when the carrying handle structure is assembled in the composite package.

Optionally, the first and second inner handle panels are not affixed to one another or to the outer strap handle panel.

According to even yet another aspect of the invention for which protection is sought, there is provided blank for forming the carrying handle structure used in the composite package, wherein the blank comprises a series of panels for forming bottom, first side and second side walls and the blank comprises a handle panel section comprising an outer strap handle panel disposed between the first and second side panels.

Optionally, the blank comprises at least one foldable tab that, when the blank is formed into a carrying handle structure, is displaceable inwardly of the carrying handle structure, and wherein the wrapping film of the composite package is punctured and at least part of the at least one foldable tab is disposed within the preliminary package for interlocking the carrying handle structure to the preliminary package.

Optionally, the blank comprises first and second inner handle panels connected to and foldable into overlapping relationship with the outer strap handle panel to reinforce the outer strap handle panel when the blank is formed into a carrying handle structure and wherein the sum of the surface area of the first and second inner handle panels is greater than the surface area of the outer strap handle panel.

Optionally, the blank comprises first and second inner handle panels connected to and foldable into overlapping relationship with the outer strap handle panel to reinforce the outer strap handle panel when the blank is formed into a carrying handle structure and wherein the blank comprises leg portions formed contiguously with each of the first and second inner handle panels, the leg portions being provided to reinforce part of the first and second side walls.

Within the scope of this application it is intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Detailed descriptions of specific embodiments of the composite package, blank and carrying handle structure are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the composite package, blank and carrying handle structure described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
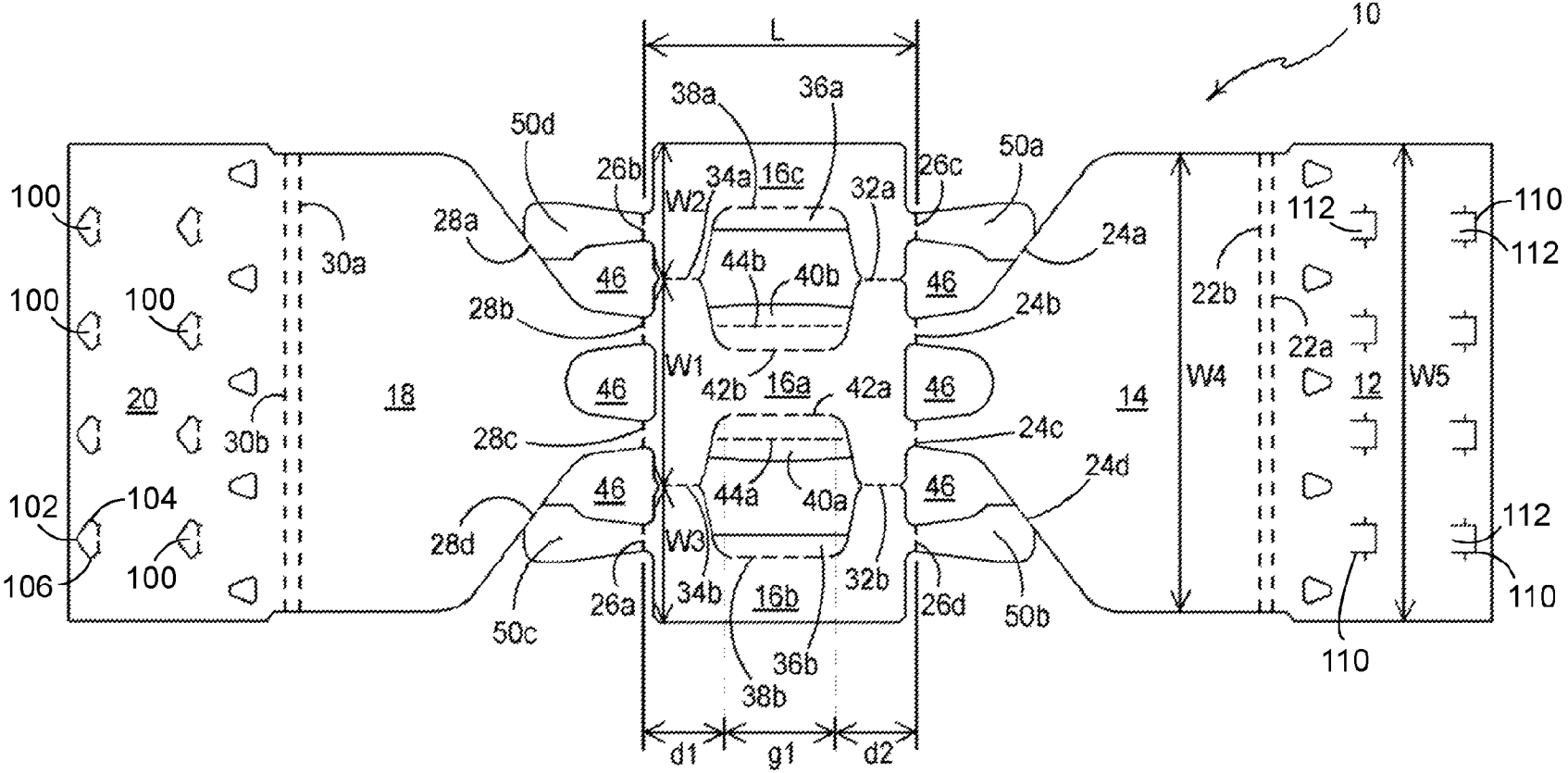
FIG. 1 is a plan view from above of a blank (optionally formed of paperboard) for forming a carrying handle structure according to a first embodiment of the invention.

Referring to FIG. 1 there is shown a plan view of a blank 10 for forming a carrying handle structure 60 (shown partially in FIG. 4) that is structured and arranged such that it can be assembled about a preliminary package 70 of cans C that have been grouped and contained by a heat-shrink, polymeric, wrapping-film 80 (see FIG. 5 for example) to form a completed composite package 90 (see FIGS. 6 to 11).

In the embodiments detailed herein, the terms "carrying handle" and "carrying handle structure" refer, for the non-limiting purpose of illustrating various features of the invention, to a handle for carrying, and/or lifting a group of articles, such as cans. However, it is contemplated that the teachings of the invention can be applied to various containers, which may or may not be tapered and/or cylindrical. Other exemplary articles include bottles (for example metallic, glass or plastics bottles), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the completed composite package 90 described in more detail below. Preferably, the blank 10 is formed from a material that does not easily stretch such that the carrying handle structure 60 formed therefrom can support the weight of the articles C being carried.

The blank 10 is configured to be formed into a carrying handle structure 60 that can be assembled about an exemplary arrangement of exemplary articles. In the illustrated embodiment, the exemplary articles are cans C and the exemplary arrangement is a dual-stack (two-layers) of articles wherein each stack or layer or tier comprises 15 cans C in a 5×3 matrix. In other embodiments, the blank 10 can be alternatively sized and configured to form a carrying handle structure 60 for packaging other types of articles and/or different arrangements of articles. Other arrangements include single layers, triple layers, and matrix arrangements ranging from 2×2.

Returning to FIG. 1, the blank 10 comprises a first bottom panel 20, a first side panel 18, an outer strap handle panel (also referred to as top panel and handle strap) 16*a*, a second side panel 14 and a second bottom panel 12. These panels are hinged one to the next in a linear series by transverse fold lines 30*b*/30*a*, 28*b*/28*c*, 24*b*/24*c* and 22*a*/22*b*. The first and second bottom panels 20, 12 are each provided with complementary locking mechanisms 100/110/112 such that the two panels 20, 12 can be affixed together. Optionally however, where a manual locking mechanism is provided, the first bottom panel 20 may be provided with a series of male locking tabs 100, each for fitting into a correspondingly sized and located female locking aperture. The female locking aperture 110 may be defined at least in part by a female locking tab 112. An optional advantageous feature provided by the carrying handle structure 60 of the present disclosure is that, the manual locking mechanism provided on the first and second bottom panels 20, 12 may be structured and arranged such that one or more of the male locking tabs 100 and/or one or more of the female locking tabs 112 punctures the wrapping film 80 disposed about the group of articles C when the carrying handle structure 60 is assembled about the preliminary package 70. In this way, the carrying handle structure 60 and the preliminary package 70 have a mechanical interlocking connection that may serve to strengthen the rigidity of the completed composite package 90 and which may prevent, or at least minimise, the risk of the carrying handle structure 60 moving or sliding relative to the preliminary package 70. Preferably, the carrying handle structure 60, once assembled, maintains a location relative to the preliminary package 70 that presents the strap of the handle 16*a*/16*b*/16*c* (further described below) in a desired location (i.e. centrally and symmetrically).

In other embodiments, other suitable means may be used for affixing the first and second bottom panels 20, 12, together; for example, they may be adhesively affixed. Additionally or alternatively in some embodiments, the carrying handle structure 60 may be affixed, connected or interlocked to the preliminary package 70 by other suitable means, for example, adhesively affixed together.

The blank 10 comprises means for forming a strap-style carrying handle that is optionally a reinforced structure comprising two or more at least partially overlaid plies of material. In the illustrated embodiment, the strap-style carrying handle is formed from three overlaid plies of material comprising: the outer strap handle panel 16*a*, a first inner strap panel 16*c* and a second inner strap panel 16*b*. The strap handle panel 16*a* and the handle reinforcing straps (the first inner strap panel 16*c* and the second inner strap panel 16*b*) together provide a handle-forming panel 16*a*/16*b*/16*c* section of the blank 10. Optionally, the outer strap handle panel 16*a* is ergonomically shaped to provide a comfortable gripping section (having length 'g1') for a user and is provided with cushioning flaps 40*a*, 40*b* either side of the gripping section for additional user comfort (each cushioning flap 40*a*, 40*b* has an optional fold line 44*a*, 44*b* to assist in its inward folding during use). The gripping section (having length 'g1') may be sized (in both its length and/or width) to correspond to (or fit within) the average size of a user's palm. Formed contiguously with the gripping section 'g1' of the outer strap handle panel 16*a* and on either side thereof, the outer strap handle panel 16*a* comprises connecting sections each having a depth 'd1', 'd2'. These connecting sections provide hinge connections 32*a*, 34*a*, 32*b*, 34*b*, 28*b*, 28*c*, 24*b*, 24*c* between the outer strap handle panel 16*a* and the adjacent first and second inner strap panels 16*c*, 16*b* and the first and second side panels 18, 14. As such, the depth 'd1', 'd2' of each connecting section may change dependent upon the distance l' between the upper edge (28*b*/28*c*) of the first side panel 18 and the upper edge (24*b*/24*c*) of the second side panel 14. This distance l' is determined by the width 'Wp' of the preliminary package 70 (see FIG. 6). As such, in the present arrangement the outer strap handle panel 16*a* is substantially 'I' shaped, with the gripping section (having length 'g1') forming the stem of the 'I' and the connecting sections (having depths 'd1', 'd2') forming the horizontal top and bottom strokes of the 'I'.

In other embodiments, where the width of the preliminary package 70 is greater than in the presently illustrated embodiment, the length 'g1' of the gripping section may remain substantially similar to that shown in FIG. 1 (because the length and/or width of the gripping section may be related to the average size of a user's palm) and the depths 'd1', 'd2' of the connecting sections may be greater than that shown in FIG. 1. As such, in other embodiments the outer strap handle panel 16*a* may have a different shape to that shown. The outer strap handle panel 16*a* may still be 'I'-shaped, but the ratio of the stem and horizontal strokes may differ.

The first and second inner strap panels 16*c*, 16*b* are each optionally connected indirectly to the first and second side panels 18, 14 by means of leg portions 50*a*, 50*d*, 50*b*, 50*c*, which are coupled to the first and second inner strap panels 16*c*, 16*b* by fold lines 26*c*, 26*b*, 26*d*, 26*a* and to the first and second side panels 18, 14 by fold lines 28*a*, 28*d*, 24*a*, 24*d*. Parts of the first and second side walls 18, 14 are reinforced by the leg portions 50*a*, 50*d*, 50*b*, 50*c*. The parts of the first and second side walls 18, 14 that are reinforced are proximate to or comprise an aperture 46. The apertures 46 are provided to receive an upper portion of an article C contained in the preliminary package 70 such that upon deployment of the handle 16*a*/16*b*/16*c* of the carrying handle structure 60 above the plane of a top surface of the preliminary package 70, the leg portions 50*a*, 50*d*, 50*b*, 50*c* and corresponding parts of the first and second side walls 18, 14 can be moved to accommodate the raising of the handle 16*a*/16*b*/16*c* of the carrying handle structure 60 above the plane of a top surface of the preliminary package 70 (see FIG. 10).

Optionally, the first and second inner strap panels 16*c*, 16*b* are each provided with a cushioning flap 36*a*, 36*b* attached along a side edge by fold lines 38*a*, 38*b* respectively. The additional cushioning flaps 36*a*, 36*b* provide a further cushioning of the user's hand which may be desirable when the completed package 90 comprises a heavy load. This is the case in the illustrated embodiment, wherein the completed package 90 may weigh in excess of 10 kg.

The blank 10 has a footprint or area defined by: the end-to-end length between the first bottom panel 20 and the second bottom panel 12; and the width 'W5' of the first bottom panel 20 and the second bottom panel 12. Preferably, for the purposes of efficient nesting of blanks 10 on a standard sheet of paperboard, the first and second inner strap panels 16*c*, 16*b* fit within the footprint of the blank 10. In order to maximise their width 'W2', 'W3' and therefore their contribution to reinforcing the carrying handle, in the illustrated embodiment, the first and second inner strap panels 16*c*, 16*b* each terminate at the perimeter of the blank's 10 footprint (as can be seen in FIG. 1). Optionally, in the illustrated arrangement, the maximum width of the perimeter of the blank's 10 area is denoted by the width 'W5' of the first or second bottom panels 20, 12. In other embodiments, the first and second side panels 14, 18 may also have a maximum width 'W4' that is the same as the maximum width of the blank's 10 footprint. In this embodiment where cushioning flaps 40*a*, 40*b* are provided, it is preferable that the first and second inner strap panels 16*c*, 16*b* do not overlap the cushioning flaps 40*a*, 40*b* once the carrying handle structure 60 is formed because otherwise, such an overlap would likely interfere with the inward folding of the cushioning flaps 40*a*, 40*b*. The maximum width 'W2', 'W3' of the first and second inner strap panels 16*c*, 16*b* is therefore defined with these considerations in mind. Optionally, the first and second inner strap panels 16*c*, 16*b* each have a width 'W2', 'W3'. The width 'W2' of the first inner strap panel 16*c* is about equal to the width 'W3' of the second inner strap panel 16*b*. The widths 'W2', 'W3' of the first and second inner strap panels 16*c*, 16*b* are each about two thirds of the maximum width 'W1' of the outer strap handle panel 16*a*. In this way the first and second inner strap panels 16*c*, 16*b* are efficiently formed within the perimeter of the blank 10, do not obstruct the cushioning flaps 40*a*, 40*b* and together provide a full two-ply and partial three-ply reinforced carrying handle additionally comprising the outer strap handle panel 16*a*.

In other words, the blank 10 for forming a carrying handle structure 60 comprises a handle strap section 16*a*/16*b*/16*c* extending between two wall panels (the first and second side panels 18, 14). The handle strap section 16*a*/16*b*/16*c* comprises: the outer strap handle panel 16*a*, the first and the second inner strap handle panels 16*c*, 16*b*. The first and the second inner strap handle panels 16*c*, 16*b* are connected to the outer handle strap panel 16*a* such that the first and second inner strap handle panels 16*c*, 16*b* are disposed on opposed sides of the outer handle strap panel 16*a* and extend alongside the outer handle strap panel 16*a* (optionally co-extensive therewith). The first and second inner strap handle panels 16*c*, 16*b* are provided to reinforce the outer strap handle panel 16*a* and the maximum width (W1+W2+W3) of the handle-forming panel section 16*a*/16*b*/16*c* is generally equal to the maximum width of either of the two carton wall panels 18, 14.

Preferably, the first and second inner strap panels 16*c*, 16*b* are each shaped and sized similarly to at least a portion of the outer strap handle panel 16*a* such that, once folded into overlapping reinforcing relationship therewith, they can each provide as much reinforcement as possible. Optionally, the sum of the surface area of the first inner strap panel 16*c* and the surface area of the second inner strap panel 16*b* is greater than the surface area of the outer strap handle panel 16*a*. In other words, at least to some extent, the first and second inner strap panels 16*c*, 16*b* overlap one another (see FIG. 4).

The first and second side panels 18, 14 are shaped so as to be narrower in dimension at their tops, where they connect with the handle 16*a*, 16*b*, 16*c* than they are at the bottom, where they connect to the bottom panels 20, 12. As such, the first and second side panels 18, 14 are tapered toward the top. The free edges of the first and second side panels 18, 14 may take a variety of shapes and forms for aesthetic and other design reasons. The shape of the first and second side panels 18, 14 as illustrated is optional. The connections 24*a*, 24*d*, 28*a*, 28*d* between the leg portions 50*a*, 50*b*, 50*d*, 50*c* and the second and first side panels 14, 18 respectively are weakened frangible connections (for example perforated connections and/or an alternating series of half-depth and full-depth cuts) that are broken during the construction of the blank 10 into a carrying handle structure 60. By having a connection the leg portions 50*a*, 50*b*, 50*d*, 50*c* are less likely to become caught or trapped in the packaging machinery used to automate the assembly of the blank 10 into the carrying handle structure 60. However, in other embodiments, there may be no connection between the leg portions 50*a*, 50*b*, 50*d*, 50*c* and the second and first side panels 14, 18 respectively, particularly where the leg portions 50*a*, 50*b*, 50*d*, 50*c* are short enough such that they are less likely to become caught in the packaging machinery used to automate the assembly of the blank 10 into the carrying handle structure 60.

Turning to the construction of the composite package 90 (see FIGS. 6 to 11); one or more layers or tiers of articles C are stacked together and wrapped with a wrapping film 80 to assemble the articles C together. Optionally, in the present illustrated embodiment, two separately wrapped layers of fifteen cans C each are formed using a heat-shrink polymeric film 80 and then stacked one on top of the other (see FIG. 5).

Figure 2:
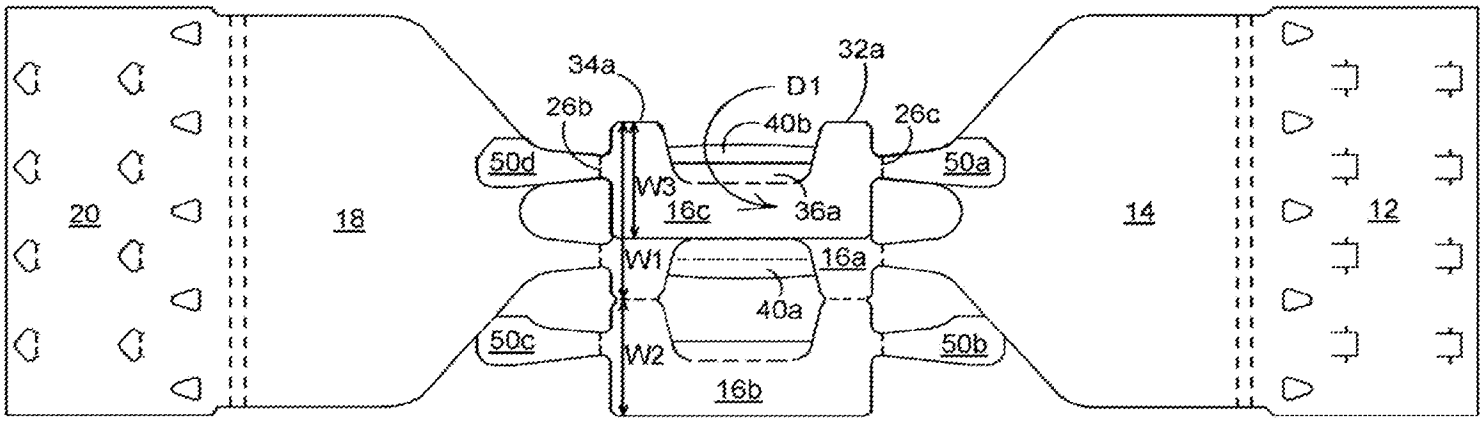
FIG. 2 is a plan view from above of the blank of FIG. 1 folded in a first optional step of construction of the blank into the carrying handle structure.

Turning to the construction of the carrying handle structure 60 as illustrated in FIGS. 2 to 5, it is intended that the carrying handle structure 60 can be formed by a series of sequential folding operations in a straight line machine so that the carrying handle structure 60 is not required to be rotated or inverted to complete its construction. The folding process is not limited to that described below and may be altered according to particular manufacturing requirements. As shown in FIG. 2, the first inner strap panel 16*c* is folded about fold lines 32*a* and 34*a* and if present the connections 24*a*, 28*a* are broken so that first inner strap panel 16*c* can be folded into flat face contacting relationship with at least part of the underside of the outer strap handle panel 16*a*. Optionally and preferably, the first inner strap panel 16*c* is not affixed by adhesive or other means to the outer strap handle panel 16*a*. This may improve the strength of the carrying handle structure 60. As described above, the first inner strap panel 16*c* is sized such that the free, cut edge of the first inner strap panel 16*c* is disposed close to the fold line 42*a* for the cushioning flap 40*a*, but not overlapping the cushioning flap 40*a* to ensure that the first inner strap panel 16*c* does not interfere with the functioning of the cushioning flap 40*a*.

Figure 3:
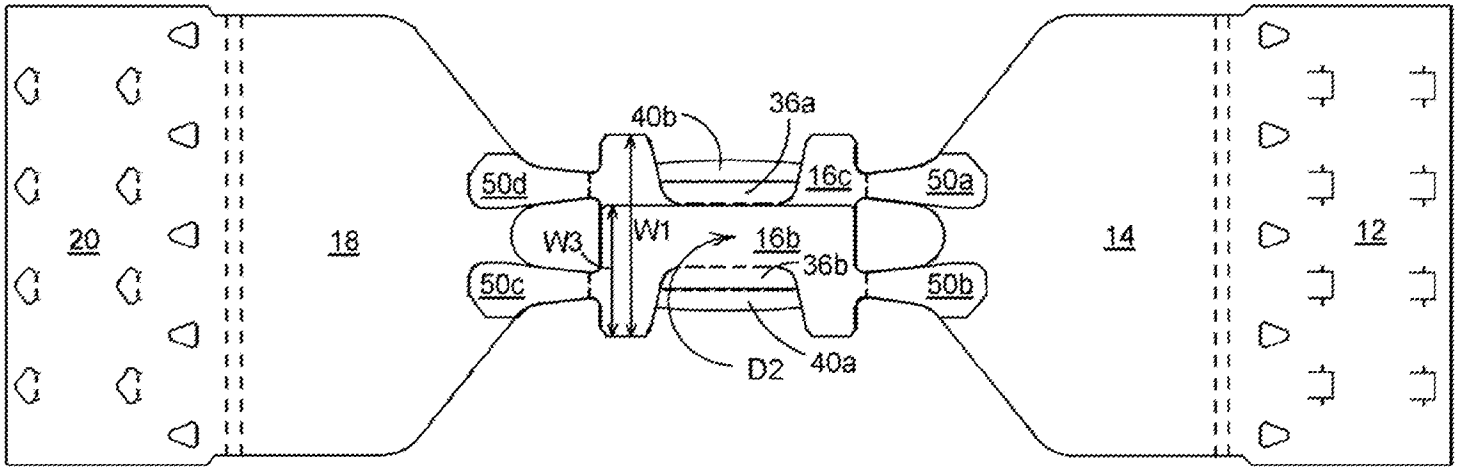
FIG. 3 is a plan view from above of the part-formed blank of FIG. 2 folded in a second optional step of construction of the carrying handle structure.

Similarly, and as shown in FIG. 3, the second inner strap panel 16*b* is folded about fold lines 32*b* and 34*b* and, if present, the connections 24*d*, 28*d* are broken so that second inner strap panel 16*b* can be folded into flat face contacting relationship with at least part of the underside of the outer strap handle panel 16*a*, and part of the outer-side of the first inner strap panel 16*c*. Optionally and preferably, the second inner strap panel 16*b* is not affixed by adhesive or other means to the outer strap handle panel 16*a* or to the first inner strap panel 16*c*. Optionally, the free, cut edge of the second inner strap panel 16*b* is disposed close to the fold line 42*b* for the cushioning flap 40*b*, but not overlapping that cushioning flap 40*b* to ensure that the second inner strap panel 16*b* does not interfere with the functioning of the cushioning flap 40*b*.

Figure 4:
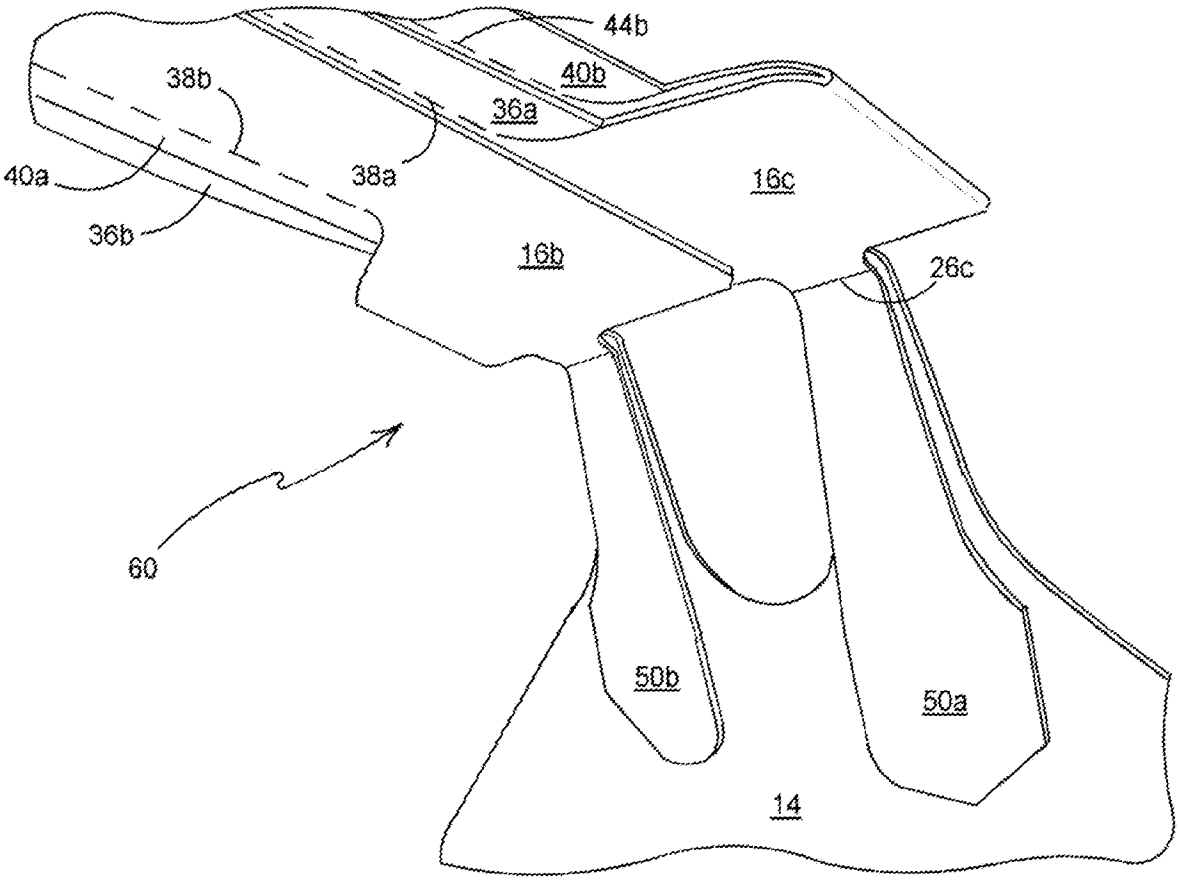
FIG. 4 is a perspective view from below of one end of the carrying handle structure formed from the blank of FIG. 1.
Figure 5:
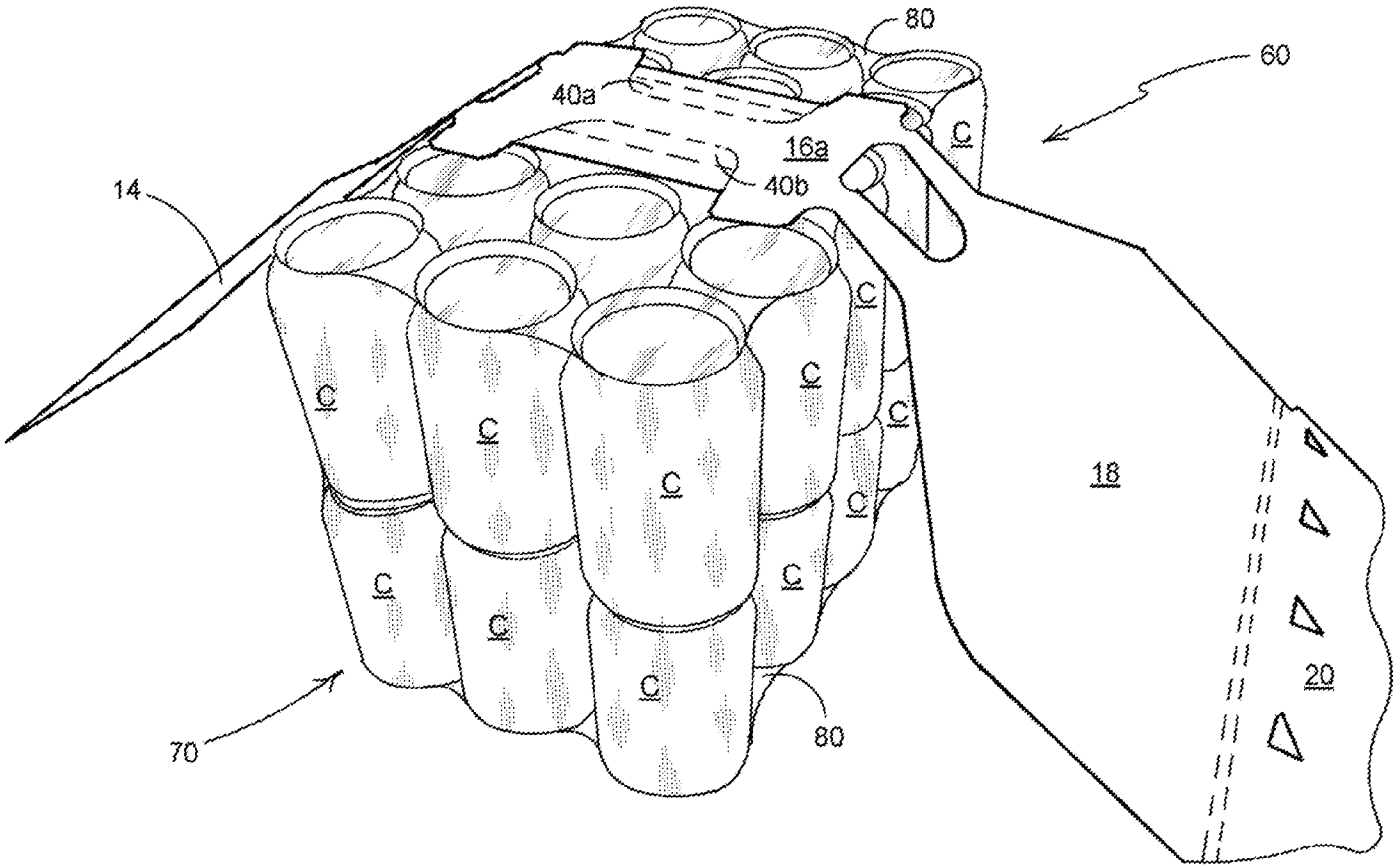
FIG. 5 is a perspective view from above of the carrying handle structure formed from the blank of FIG. 1, being assembled about a preliminary package of cans that have been grouped and contained by a heat-shrink, polymeric, wrapping-film.

The first and second side panels 18, 14 are then folded downwardly with respect to the outer strap panel 16*a*, about fold lines 24*b*, 24*c*, 28*b* and 28*c* (see FIG. 4). At or before this point in the construction of the carrying handle structure 60, the folded blank 10 may be placed on top of one or more layers of film-wrapped articles 'C' (see FIG. 5) of the preliminary package 70.

The first and second side panels 18, 14 are folded until they are disposed in face contacting relationship with the sides of the preliminary package 70. The apertures 46 allow the carrying handle structure 60 to be tightly wrapped about the preliminary package 70. Each aperture 46 accommodates an upper portion of an adjacent can C (see FIGS. 6 and 7). The first and second bottom panels 20, 12 are folded about their respective hinge connections 30*a*/30*b*, 22*a*/22*b* and brought into overlapping relationship with one another, underneath the preliminary package 70. Manually, or by an automated packaging machine, the male locking tabs 100 of the mechanical locking mechanism (which may be a punch-type locking mechanism) are punched into and partially through the female locking apertures 110. In forcing or punching the male tab 100 though the female locking aperture 110, the wrapping film 80 may also be punctured (either by the tab or by a tool or instrument used manually or by an automated packaging assembly). Additionally, at least part of the male tab 100 (and/or the female tab 112 that defines at least in part the female aperture 110) may be pushed through a hole thereby created in the wrapping film 80 and into the preliminary package 70. In this way a mechanism for interlocking the preliminary package 70 and the carrying handle structure 60 is provided.

In the illustrated arrangement (see in particular FIG. 12), the two-part complementary mechanical locking mechanism comprises two parallel rows of four foldable, male locking tabs 100 in the first bottom panel 20 and two parallel rows of four female locking apertures 110 in the second bottom panel 12. The female locking apertures 110 are each defined by foldable retaining tabs 112 which are displaced when the male locking tabs 100 are inserted into the female locking apertures 110. Each male tab 100 comprises a leading arrow-head 102 and wider shoulders 104, 106 and the wider shoulders 104, 106 act as an anchor to interlock the carrying handle structure 60 to the polymeric wrapping film 80 of the preliminary package 70.

Figure 13A:
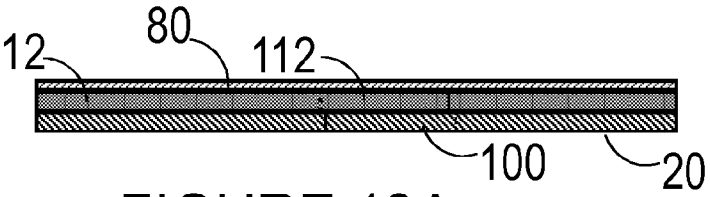
FIG. 13A is a cross-section through part of a bottom wall of the carrying handle structure and through the wrapping film of the preliminary package wherein two-parts of a punch-lock style locking mechanism formed in overlapping bottom panels of the carrying handle structure are shown in a non-deployed state.
Figure 13B:
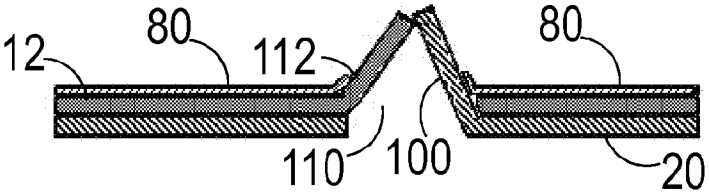
FIG. 13B is a cross-section through part of a bottom wall of the carrying handle structure and through the wrapping film of the preliminary package wherein two-parts of a punch-lock style locking mechanism formed in overlapping bottom panels of the carrying handle structure are shown in a deployed state.
Figure 12:
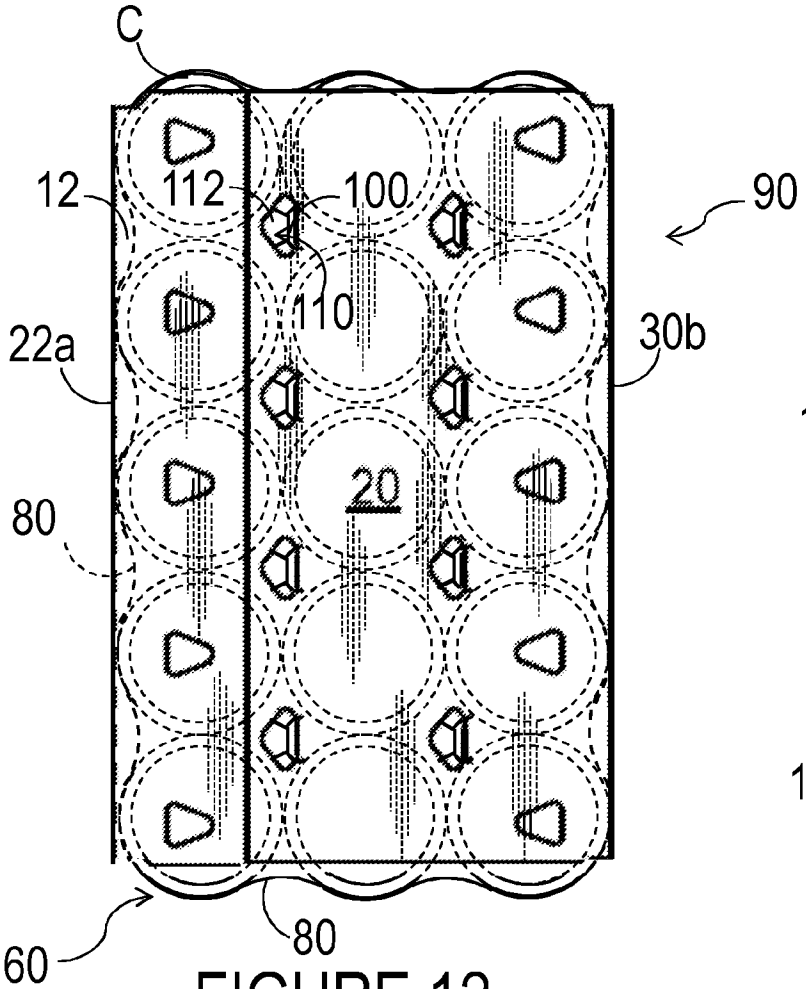
FIG. 12 is a plan view from the bottom of the completed composite package of FIGS. 7, 8 and 9 wherein the parts of the preliminary package of grouped cans contained by heat-shrink, polymeric, wrapping-film that would be obscured from view by the bottom panels of the carrying handle structure have been illustrated in dotted outline.

In FIG. 12 a plan view of the composite bottom wall 12/20 of the completed composite package 90 is shown. The wrap 80 and articles C of the preliminary package 70 that would otherwise be occluded from view by the presence of the connected first and second bottom panels 12, 20 have been drawn in dotted outline. It can be seen that once the eight locking mechanisms 100/112/110 have each been deployed, the male and female tabs 100, 112 are disposed internally of the carrying handle structure 60 and internally of the preliminary package 70. This is also illustrated by FIGS. 13A and 13B which show a cross-section of only one pair of male and female tabs 100, 112, first in an unlocked, non-deployed state (see FIG. 13A) and then having been "punched through", in a locked, deployed state (see FIG. 13B). In FIG. 13B it can be seen that the female tab 112 has been displaced out of the plane of the second bottom panel 12 and in doing so an aperture 110 has been created. The outermost male tab 100 has been displaced out of the plane of the first bottom panel 20 and has moved into the aperture 110. The male and female tabs 100, 112 interlock and hold the first and second bottom panels 20, 12 together. It can be seen that the displacement of the male and female tabs 100, 112 (optionally facilitated by the insertion of a tool) has punctured the wrapping film 80 such that the interlocked male and female tabs 100, 112 are disposed within the preliminary package 70. It will be realised that by forcing a tab 100, 112 through the wrapping film 80, movement of the preliminary package 70 relative to the carrying handle structure 60 is prevented or at least minimised.

In other embodiments at least one foldable tab may be provided in a variety of suitable locations on the carrying handle structure 60 for being displaced inwardly of the carrying handle structure 60 and into the preliminary package 70 by puncturing the wrapping film 80. In some embodiments the at least one foldable tab 100 may be formed within a first bottom panel 20 of the carrying handle structure 60 and the at least one foldable tab 100 may form part of a two-part complementary mechanical locking mechanism 100/110/112 that secures the first bottom panel 20 to a second bottom panel 12 of the carrying handle structure 60. In other embodiments, the two-part complementary mechanical locking mechanism comprises a series of at least three male locking tabs and a series of at least three female locking apertures.

Figure 6:
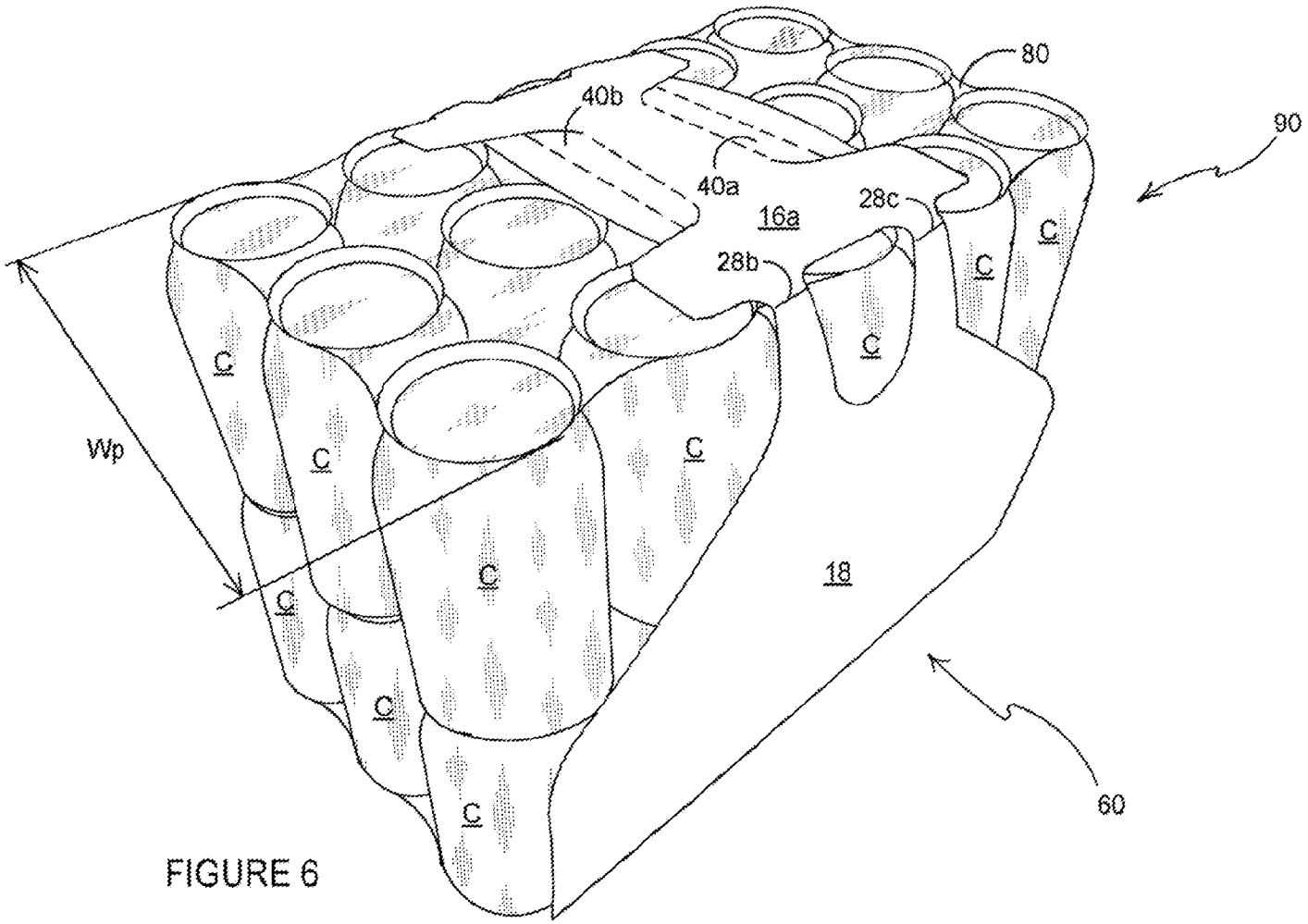
FIGS. 6 and 7 show perspective views from above of a completed composite package that comprises: the preliminary package shown in FIG. 5 of grouped cans that are contained by a heat-shrink, polymeric, wrapping-film; and the carrying handle structure formed from the blank of FIG. 1 that has been assembled about the preliminary package.
Figure 7:
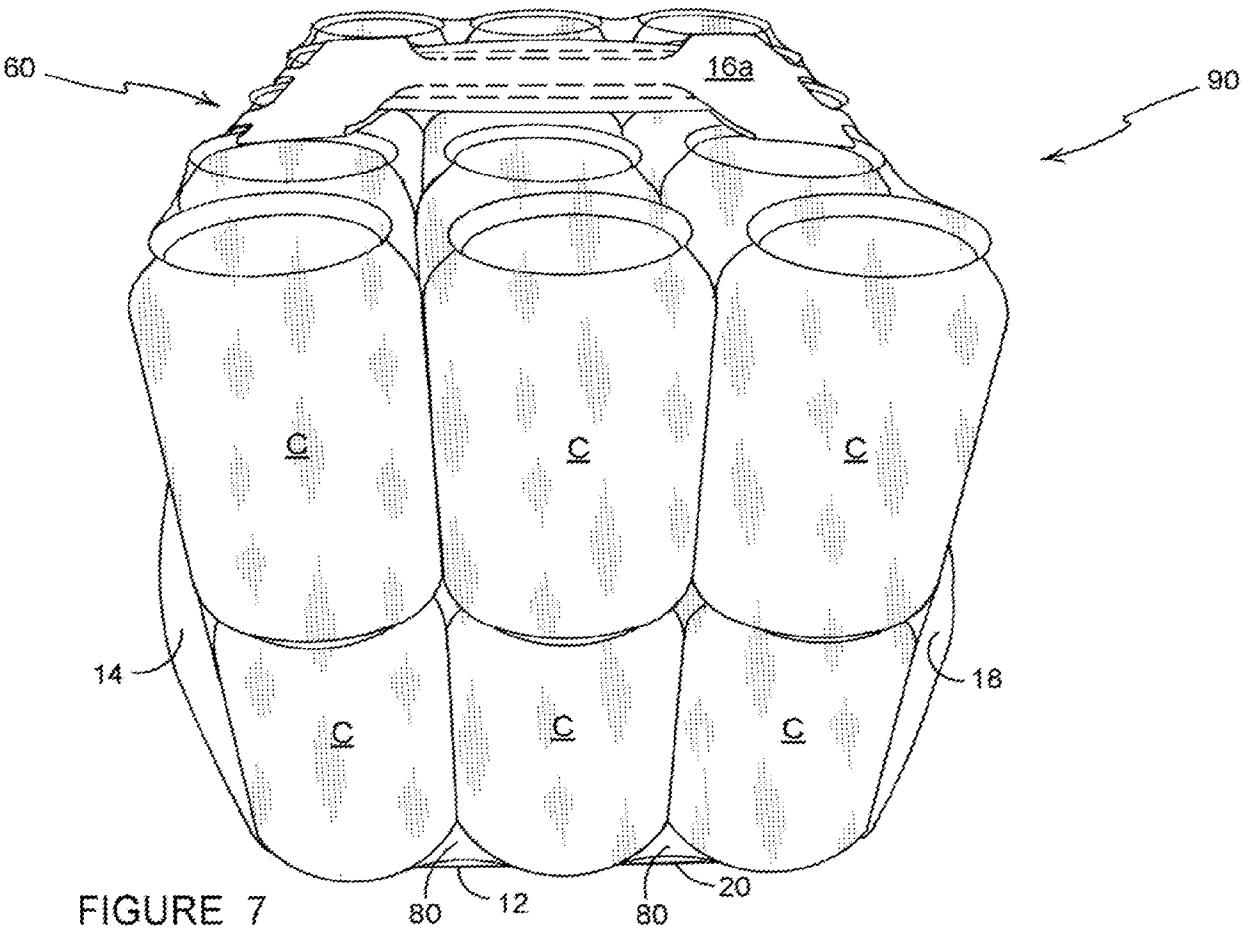
Figure 8:
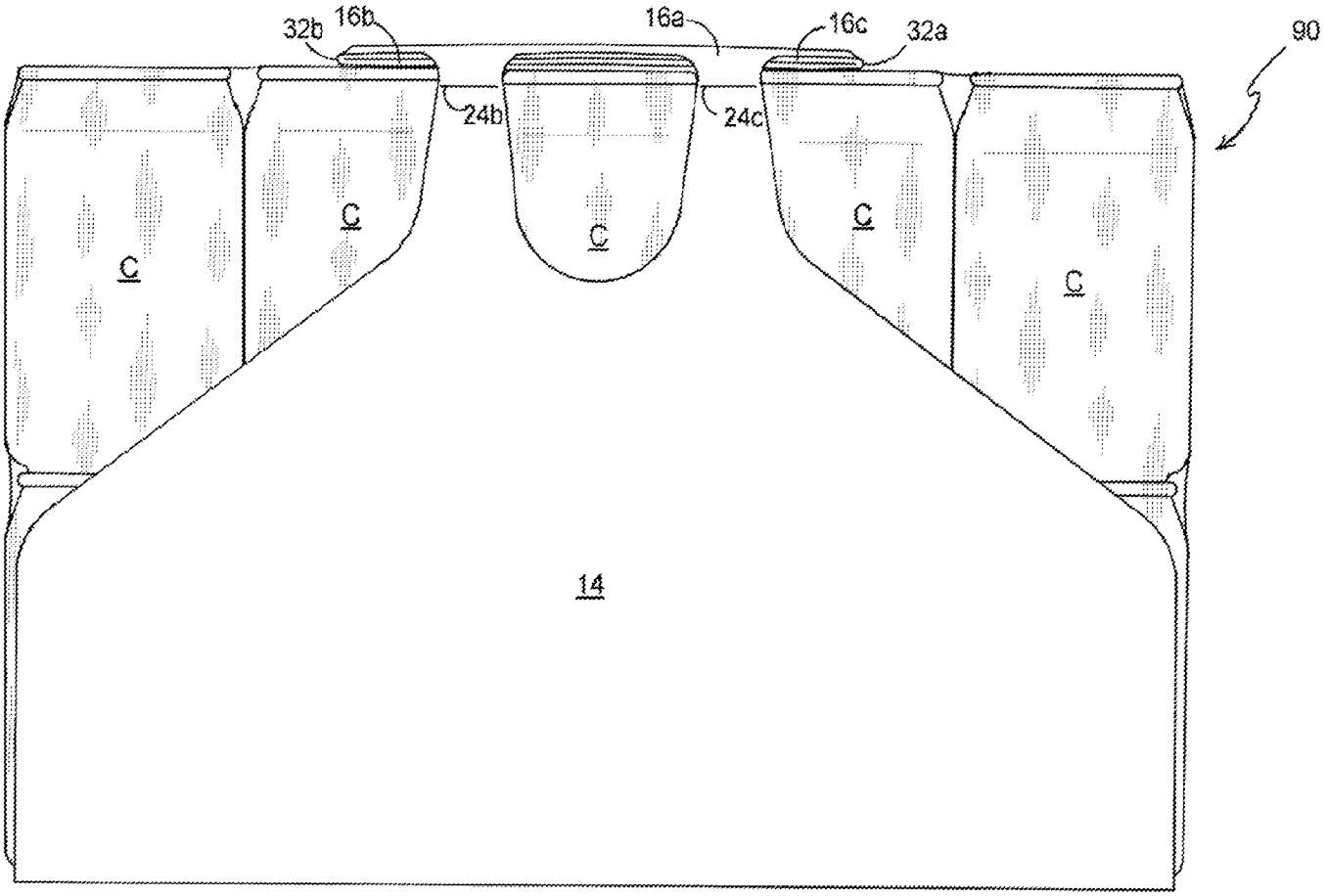
FIG. 8 shows a side view of a completed composite package.
Figure 10:
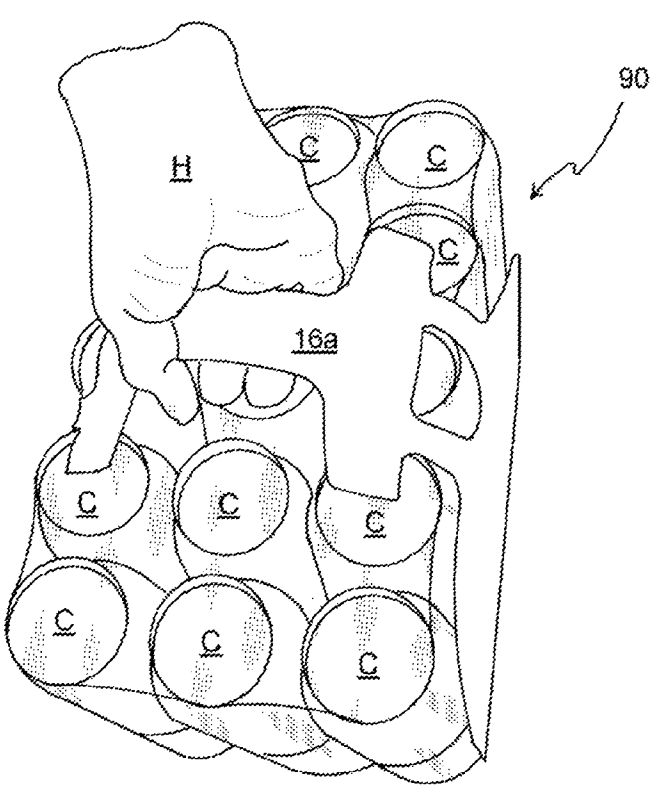
FIGS. 9, 10 and 11 are perspective views from above of the completed composite package of FIGS. 7, 8 and 9 being lifted and held by the carrying handle structure.
Figure 9:
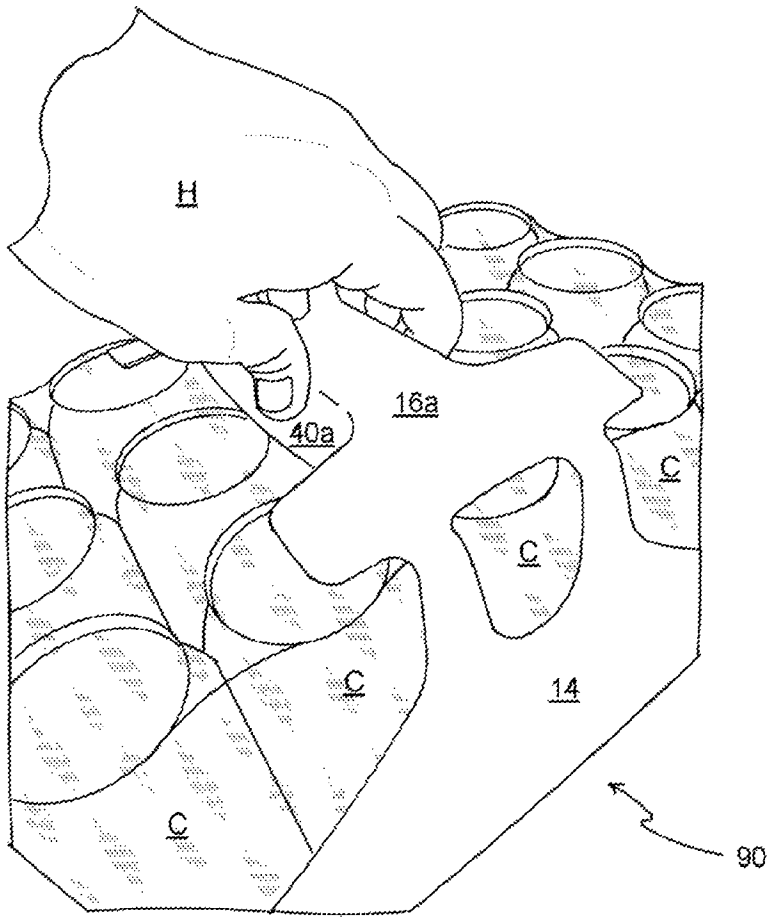
Figure 11:
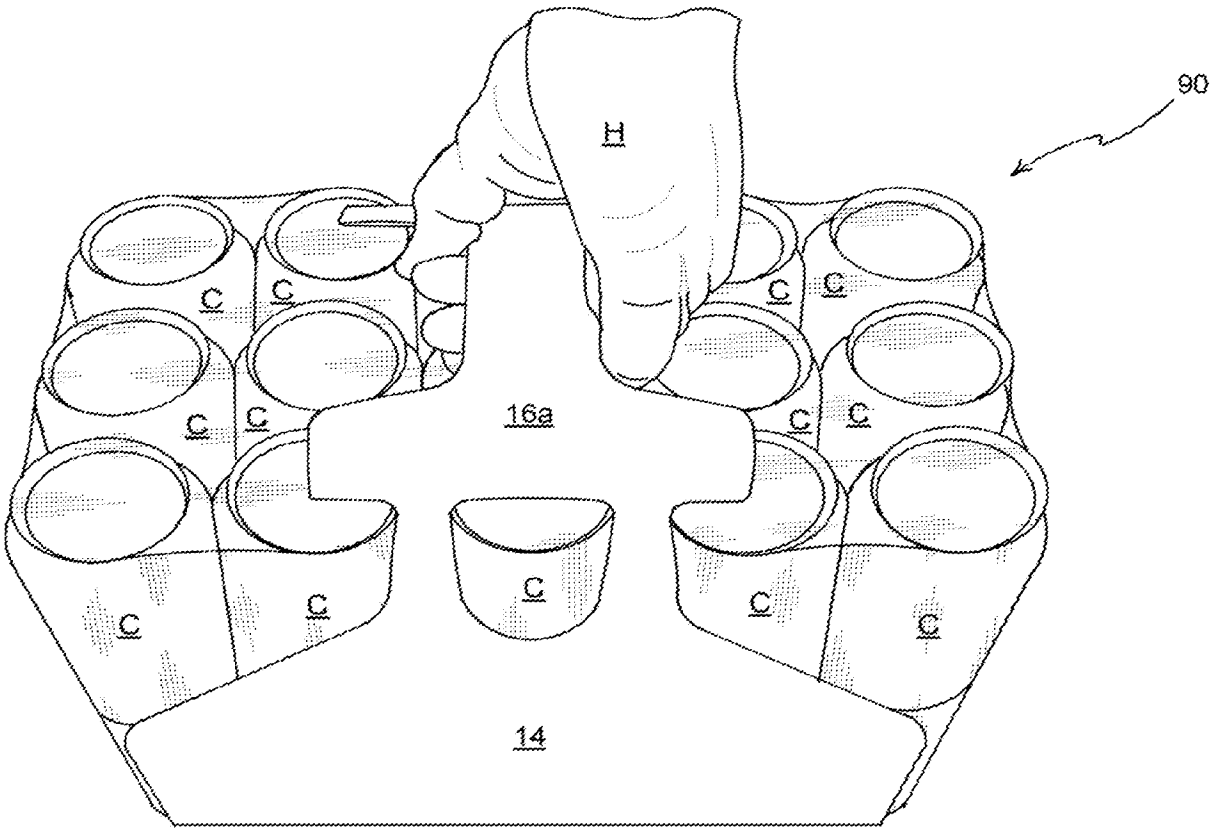

Once the carrying handle structure 60 has been attached to the preliminary package 70, the completed composite package 90 is formed (see FIGS. 6 to 8). The carrying handle structure 60 can be gripped by a user at the gripping section and the cushioning flaps 40*a*, 40*b* provide extra comfort to the user's hand H. The user's hand H can partially fit beneath the gripping section (for example, see FIG. 10). The handle 16*a*/16*b*/16*c* can be lifted above the upper surface of the preliminary package 70. The apertures 46 facilitate this. As the completed composite package 90 is lifted, a significant downward force (due to the weight of the articles C) is applied to the handle. The leg portions 50*a*, 50*b*, 50*c*, 50*d* as well as the partial three-ply construction of the carrying handle 60 provide a strong handle structure that can support the weight or load of the articles 'C'

It can be appreciated that various changes may be made within the scope of the present invention. For example, the size and shape of the panels and apertures may be adjusted to accommodate articles of differing size or shape. In other embodiments of the invention the leg portions 50*a*, 50*b*, 50*c*, 50*d* may have a different size or shape and may remain connected to the side panels 18, 14 after they have been folded. To achieve this, their shape and/or the angle of the sloping side wall of the first and second side panels 18, 14 may differ from that shown. In yet other embodiments, the shape of the first and second side panels may vary; in particular, the first and second side panels may not be fully co-extensive at their bottom edges with the bottom panels 20, 12. However, it may be preferable to maximise the printable area of the first and second side panel 18, 14 so that the aesthetic effects and area for advertising graphics can be maximised.

It will be recognised upon reading the foregoing that other external structures may be wrapped about a preliminary package, which external structures may be formed of a material such as paperboard, cardboard or the like, which optionally may be printable with graphics, advertising indicia and/or other marketing or promotional designs. Such external structures may not necessarily provide a carrying handle structure, but may in the simplest form provide a sleeve for placing about the preliminary package to carry high-quality printed graphics which may improve the promotional quality or value of the preliminary package. Any and other such external structures may still nevertheless employ the beneficial feature of at least one foldable or displaceable tab that can be disposed internally of the preliminary package to interlock the external structure and the preliminary package to, for example, secure the external structure to the preliminary package and/or restrict relative movement between the two. Optionally, the at least one foldable tab may form part of a mechanical locking mechanism for interlocking two panels (for example bottom panels) of the external structure together. However, it is also intended that in some arrangements, the at least one foldable tab may be disposed in a variety of suitable locations on the external structure; for example the at least one foldable tab may be formed in a side wall or a top wall. Furthermore, whereas the foldable tab has been described in terms of a punch-type mechanical locking mechanism wherein a tool used to displace the at least one foldable tab additionally may puncture the wrapping film of the preliminary package, it is intended that in other embodiments, puncturing of the wrapping film may be conducted separately to displacement of the at least one foldable tab. In conjunction with displacing the foldable tab the foldable tab may be provided with means for puncturing the wrapping film such as a pointed leading edge or head and/or the foldable tab may further be provided with an anchoring means such as a wider shoulder portion, a hook-shaped portion or other suitable projection (e.g. barb).

It will be recognised that as used herein, directional references such as "top", "bottom", "front", "back", "end", "side", "inner", "outer", "upper" and "lower" do not limit the respective panels to such orientation, but merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is intended that hinged connection can be formed from any one or more of the following: a short slit, a frangible line or a fold line, without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

As used herein, the term "wrapping film" refers to all manner of sheets of material that can be used to securely group articles together when wrapped about them and affixed in place. Wrapping films may be transparent, translucent, printed, opaque, coloured, plastic, plastics material, polymeric material, polyolefin, PVC, single layer, multiple layers, co-extrusions, heat-shrinkable and/or curable.

It should be understood that hinged connection, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A composite package comprising at least one preliminary package and a carrying handle structure, wherein the at least one preliminary package comprises a group of articles contained and secured together as a unit by a wrapping film disposed around the group and wherein the carrying handle structure is wrapped around the at least one preliminary package and wherein the carrying handle structure is provided with at least one foldable tab that is disposed within the at least one preliminary package for interlocking the carrying handle structure to the at least one preliminary package, wherein the at least one foldable tab is forcibly pushed or displaced inwardly of the carrying handle structure such that the wrapping film is punctured and at least part of the at least one foldable tab is disposed internally of the wrapping film of the at least one preliminary package.

2. A composite package according to claim 1 wherein the at least one foldable tab secures the carrying handle structure to the at least one preliminary package.

3. A composite package according to claim 1 wherein the at least one preliminary package comprises two or more preliminary packages and wherein the two or more preliminary packages are stacked one on top of another.

4. A composite package according to claim 1 wherein the at least one foldable tab is formed within a first bottom panel of the carrying handle structure and wherein the at least one foldable tab forms part of a two-part complementary mechanical locking mechanism that secures the first bottom panel to a second bottom panel of the carrying handle structure.

5. A composite package according to claim 4 wherein the two-part complementary mechanical locking mechanism comprises a series of at least three male locking tabs and a series of at least three female locking apertures and wherein each male tab comprises a leading head and shoulders wider than the head and wherein the shoulders act as an anchor to interlock the carrying handle structure and the at least one preliminary package.

6. A composite package according to claim 5 wherein the two-part complementary mechanical locking mechanism comprises two parallel rows of four male locking tabs and two parallel rows of four female locking apertures and wherein the female locking apertures are each covered by a retaining tab prior to the male locking tabs being inserted into the female locking apertures.

7. A composite package according to claim 1 wherein the carrying handle structure comprises a top wall, first and second side walls and a bottom wall and wraps around the preliminary package and wherein the carrying handle structure is provided with an outer strap handle panel in the top wall, which is reinforced by first and second inner handle panels disposed in overlapping relationship with the outer strap handle panel and wherein the sum of the surface area of the first and second inner handle panels is greater than the surface area of the outer strap handle panel.

8. A composite package comprising a preliminary package and a carrying handle structure, wherein the preliminary package comprises a group of articles contained and secured together as a unit by a wrapping film disposed around the group and wherein the carrying handle structure comprises a top wall, first and second side walls and a bottom wall and wraps around the preliminary package and wherein the carrying handle structure is provided with an outer strap handle panel in the top wall, the outer strap handle panel being reinforced by first and second inner handle panels disposed in overlapping relationship with the outer strap handle panel to form a handle and wherein leg portions formed contiguously with each of the first and second inner handle panels reinforce part of the first and second side walls.

9. The composite package according to claim 8 wherein the part of the first and second side walls reinforced by the leg portions have an aperture for receiving an upper portion of an article contained in the preliminary package such that upon raising of the handle above a plane of a top surface of the preliminary package, the leg portions and corresponding parts of the first and second side walls can be moved to accommodate the raising of the handle above the plane of the top surface of the preliminary package.

10. The composite package of claim 9 wherein the leg portions are connected to an edge of each of the first and second side walls by a frangible connection when the carrying handle structure is in blank form, the frangible connection is broken during construction such that the leg portions are not directly attached to the first and second side walls when the carrying handle structure is assembled in the composite package.

11. The composite package of claim 8 wherein the first and second inner handle panels are not affixed to one another or to the outer strap handle panel.

* * * * *